US005555829A

United States Patent [19]

Katou

[11] Patent Number: 5,555,829

[45] Date of Patent: Sep. 17, 1996

[54] DRIVING APPARATUS FOR A SEWING MACHINE

[75] Inventor: Yutaka Katou, Kariya, Japan

[73] Assignee: Aisin Seiki Kabushiki Kaisha, Kariya, Japan

[21] Appl. No.: 500,201

[22] Filed: Jul. 10, 1995

[30] Foreign Application Priority Data

Jul. 13, 1994 [JP] Japan ..... 6-161430

[51] Int. Cl.[6] ..... D05B 69/12

[52] U.S. Cl. ..... 112/220

[58] Field of Search ..... 112/220, 217.3, 112/221, 258, 259; 474/101, 112, 205, 202, 204

[56] References Cited

U.S. PATENT DOCUMENTS

| | | | |
|---|---|---|---|
| 376,975 | 1/1888 | Adie | 474/205 X |
| 2,793,600 | 5/1957 | Francois | 112/220 |
| 2,964,001 | 12/1960 | Walling et al. | 112/220 |
| 3,602,167 | 8/1971 | Papajewski | 112/220 X |
| 4,276,039 | 6/1981 | Takano | 474/205 |
| 5,273,496 | 12/1993 | White, Jr. | 474/205 X |
| 5,322,027 | 6/1994 | Hashiride et al. | 112/220 |

FOREIGN PATENT DOCUMENTS

| | | | |
|---|---|---|---|
| 54-135057 | 10/1979 | Japan . | |
| 2-17576 | 5/1990 | Japan . | |
| 154154 | 4/1956 | Sweden | 112/220 |

*Primary Examiner*—Ismael Izaguirre

*Attorney, Agent, or Firm*—Oblon, Spivak, McClelland, Maier & Neustadt, P.C.

[57] ABSTRACT

The invention is directed to a driving apparatus for a sewing machine which has a table, an upper rotary shaft provided horizontally above the table for driving a needle, a lower rotary shaft provided horizontally below the table for driving a shuttle, a transmission mechanism for transmitting a rotational force to rotate the upper rotary shaft and the lower rotary shaft in synchronous relationship with each other, and a driving device for rotating the upper rotary shaft and the lower rotary shaft. The transmission mechanism includes a first toothed pulley which is mounted on the upper rotary shaft and rotated together therewith, a second toothed pulley which is mounted on the lower rotary shaft and rotated together therewith, and a double toothed belt on both sides of which is provided with teeth for meshing with the first toothed pulley and the second toothed pulley, respectively. The belt is held to be meshed with the first toothed pulley at one side of the belt, and held to be meshed with the second toothed pulley at the other side of the belt.

7 Claims, 3 Drawing Sheets

DRIVING APPARATUS FOR A SEWING MACHINE

BACKGROUND OF THE INVENTION

1. Field of the Invention

The present invention relates to a driving apparatus for a sewing machine, more particularly to the apparatus for driving an upper rotary shaft and a lower rotary shaft of the sewing machine.

2. Description of the Prior Art

In a conventional sewing machine for sewing a workpiece, e.g. a piece of cloth, or embroidering the cloth, a shuttle has to be rotated in the reverse direction to an upper rotary shaft. Therefore, according to an apparatus disclosed in Japanese Utility-model Publication for opposition No. 2-17576, each of an upper rotary shaft and a lower rotary shaft is provided with a bevel gear to rotate integrally therewith, respectively, and supported horizontally. The upper and lower rotary shafts are rotated together by a vertical shaft which is provided at its opposite ends with bevel gears to be meshed with the bevel gears of the upper and lower rotary shafts respectively, so that the upper rotary shaft is rotated by a driving source which is operatively connected to the upper rotary shaft thereby to rotate the lower rotary shaft in the reverse direction to the upper rotary shaft.

However, since the upper and lower rotary shafts are linked by the gears, a noise tends to be caused as they are rotated with the gears meshed with each other. Therefore, in general, lubricant is applied to the gears, and the working accuracy of the gears or a housing for receiving therein the gears and the assembling accuracy of them are required to be relatively high, which necessarily results in increase in cost.

Also, it has been proposed in Japanese Patent Laid-open Publication No. 54-135057 to employ a toothed belt for transmitting the rotational force of the driving source to the upper rotary shaft and transmitting the rotational force of the upper rotary shaft to the lower rotary shaft. As a result, the noise is reduced, while the lubricant is not necessarily applied, and the dimensional accuracy is not required to be so high in working or assembling operations, which result in decrease in cost.

According to the apparatus disclosed in the above-described publication No. 54-135057, however, the upper and lower rotary shafts rotate in the same direction, so that a complex mechanism is required so as to rotate a bobbin in the reverse direction to the lower rotary shaft, which results in increase in cost. In addition, the driving source and the upper rotary shaft are driven by the toothed belt, respectively, so that a pair of toothed belts are necessitated, which results in increase in cost.

SUMMARY OF THE INVENTION

Accordingly, it is an object of the present invention to provide a driving apparatus for a sewing machine at relatively low cost comparing with the prior machines.

It is another object of the present invention to provide a driving apparatus for a sewing machine to rotate the upper rotary shaft and lower rotary shaft in the reverse direction to each other with a belt.

In accomplishing these and other objects, a driving apparatus is provided for a sewing machine which has a table, an upper rotary shaft provided horizontally above the table for driving a needle, a lower rotary shaft provided horizontally below the table for driving a shuttle, a transmission mechanism for transmitting a rotational force to rotate the upper rotary shaft and the lower rotary shaft in synchronous relationship with each other, and a driving device for rotating the upper rotary shaft and the lower rotary shaft. The transmission mechanism includes a first toothed member which is provided on the upper rotary shaft to rotate together therewith, a second toothed member which is provided on the lower rotary shaft to rotate together therewith, and a double toothed belt, both sides of which are provided with teeth for meshing with the first toothed member and the second toothed member, respectively. The belt is held by a holding device so as to be meshed with the first toothed member at one side of the belt, and meshed with the second toothed member at the other side of the belt.

The driving device may include an output shaft for generating the rotational force, and the output shaft holds the belt so as to be meshed with the first toothed member at one side of the belt, and holds the belt to be meshed with the second toothed member at the other side of the belt.

The holding device may include an idle pulley which is mounted on the table in parallel spaced relationship with the first and second rotary shafts, on the periphery of which a toothed portion is provided for meshing with the double toothed belt.

The number of teeth which are provided on the one side of the belt may be different from the number of teeth which are provided on the other side of the belt.

In the sewing machine which has the table, the upper rotary shaft and the lower rotary shaft as described above, the driving apparatus preferably comprises a first toothed pulley which is mounted on the upper rotary shaft and rotated together therewith, a second toothed pulley which is mounted on the lower rotary shaft and rotated together therewith, a motor which is mounted on the table and which has a rotational output shaft provided in parallel spaced relationship with the upper and lower rotary shafts, a third toothed pulley which is mounted on the output shaft of the motor and rotated together with the output shaft, a fourth toothed pulley which is rotatably mounted on the table, with the central axis of the fourth toothed pulley provided in parallel spaced relationship with the upper and lower rotary shafts, and a double toothed belt, both sides of which are provided with teeth. And, one side of the belt is arranged to mesh with the first toothed pulley, the third toothed pulley and the fourth toothed pulley, while the other side of the belt is arranged to mesh with the second toothed pulley. In this respect, the fourth toothed pulley is preferably mounted so as to be movable vertically, and fixed at a position for providing a tension for the belt to mesh with the first, second and third toothed pulleys.

BRIEF DESCRIPTION OF THE DRAWINGS

The above stated objects and following description will become readily apparent with reference to the accompanying drawings, wherein like reference numerals denote like elements, and in which.

DESCRIPTION OF THE PREFERRED EMBODIMENT

Figure 1:
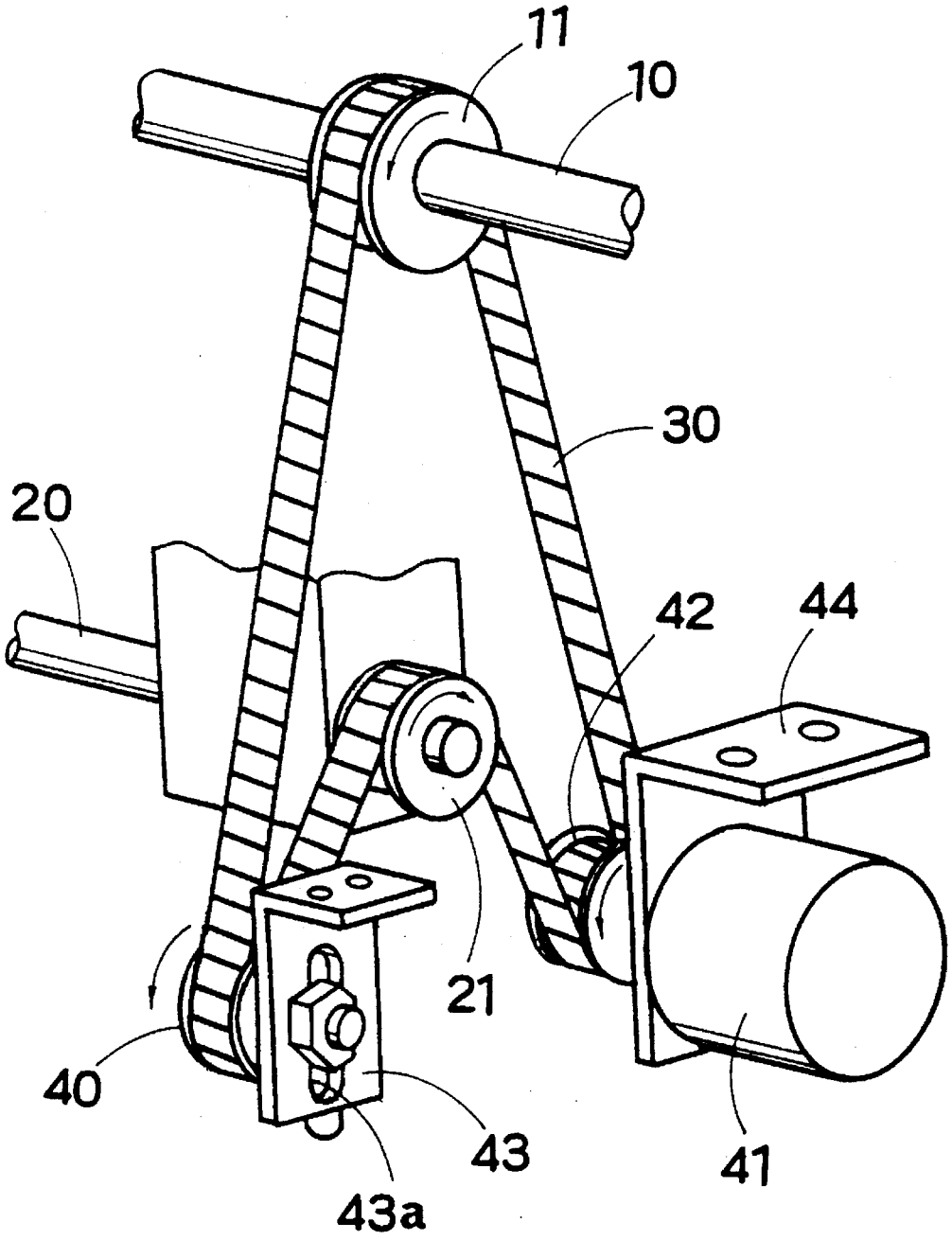
FIG. 1 is a perspective view showing a mechanism of a driving apparatus according to an embodiment of the present invention.
Figure 2:
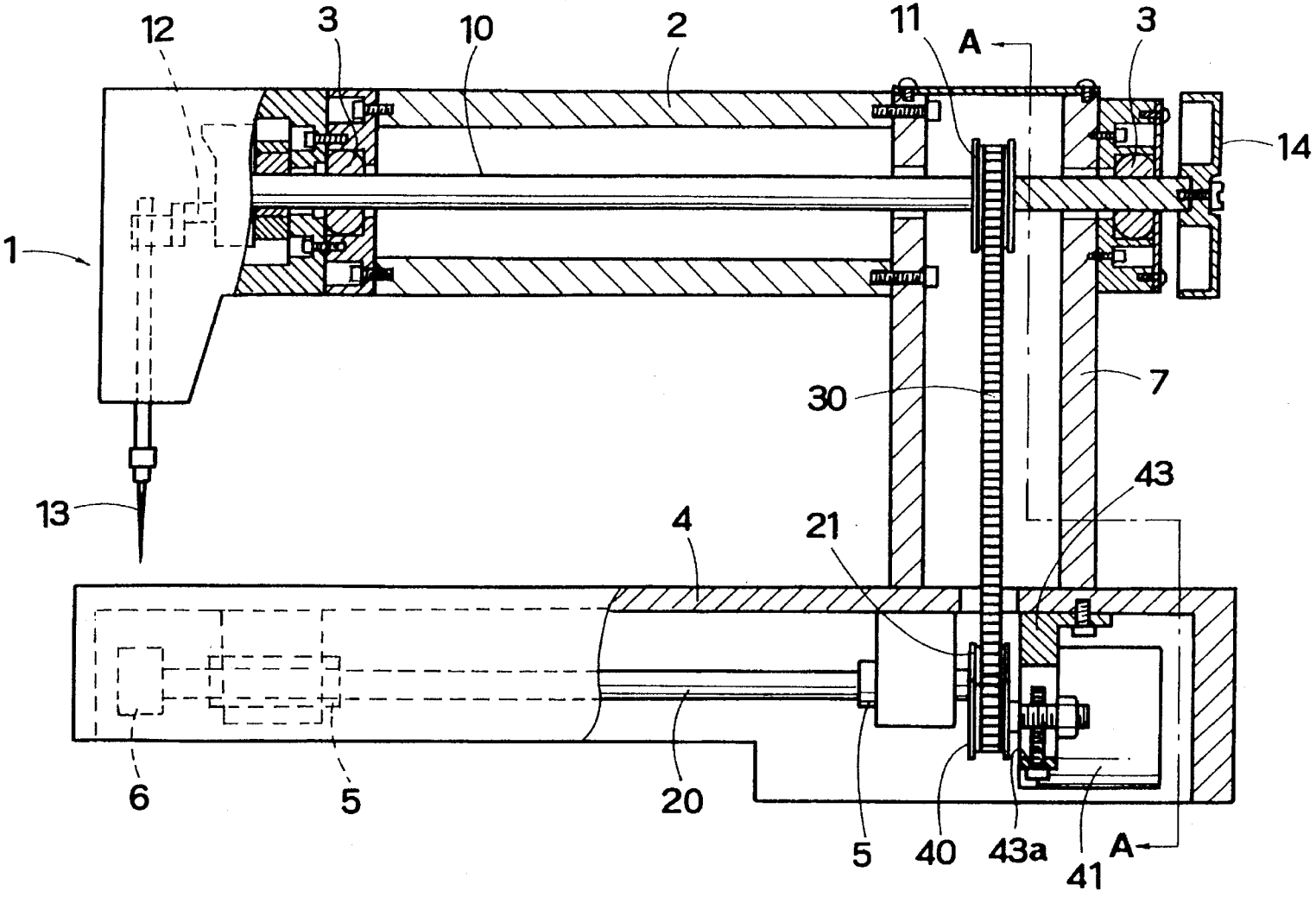
FIG.2 is a front sectional view of a sewing machine according to an embodiment of the present invention.
Figure 3:
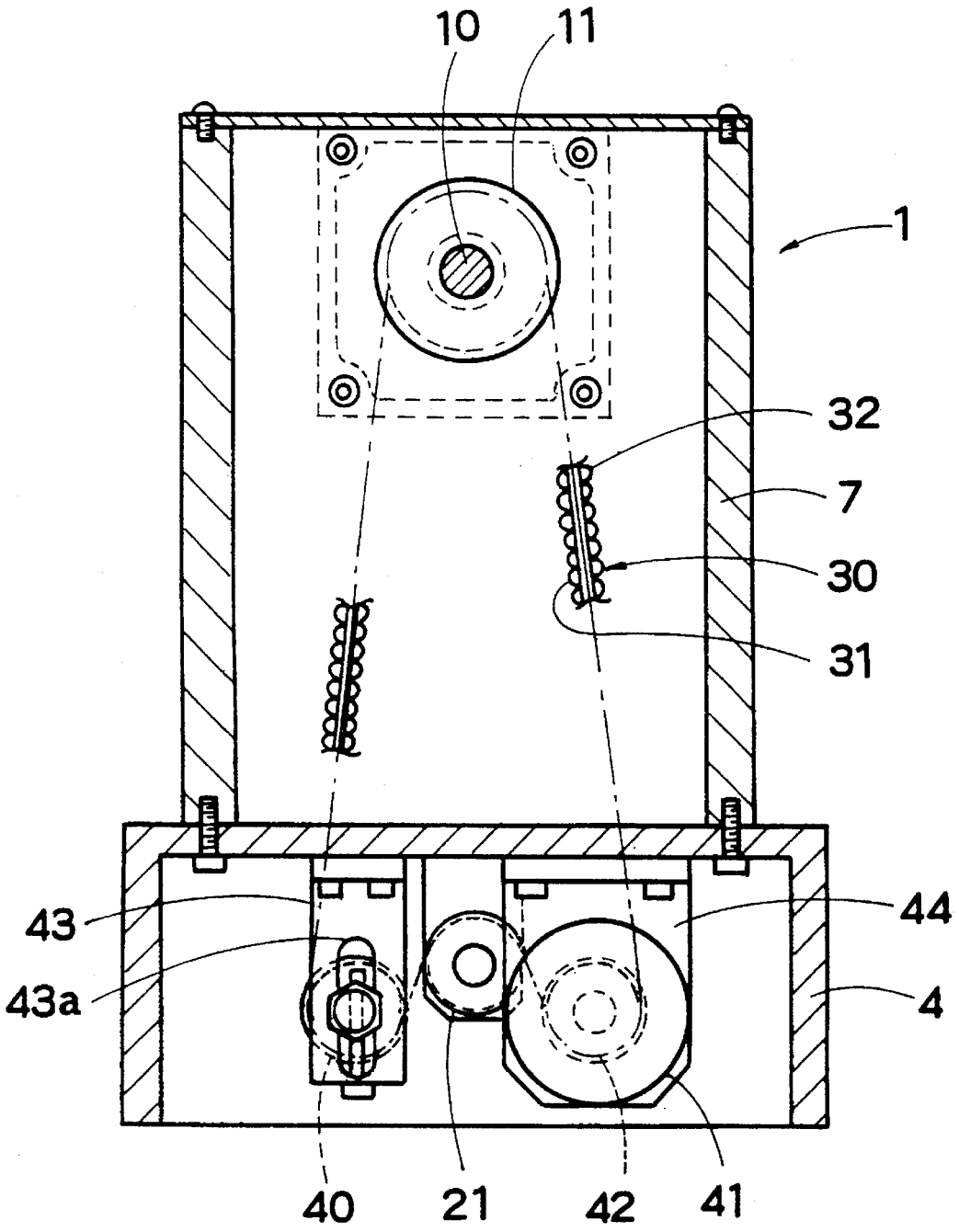
FIG.3 is a view sectioned along a line A—A in FIG.2.

Referring to FIG. 1, there is illustrated a mechanism of a driving apparatus for use in a sewing machine 1 as shown in FIG.2 for sewing a workpiece, or a piece of cloth, according to an embodiment of the present invention. An arm 2, which is formed by extruding aluminium, is mounted on a cylindrical member 7, which is also formed by extruding aluminium and secured to a table 4.

The driving apparatus includes an upper rotary shaft 10 and a lower rotary shaft 20 (hereinafter, simply referred to as an upper shaft 10 and a lower shaft 20, respectively), which are provided with a toothed pulley 11 and a toothed pulley 21 to rotate together, respectively, a double toothed belt 30, on one side of which teeth 31 are formed to mesh with the toothed pulley 11, and the other side of which teeth 32 are formed to mesh with the toothed pulley 21, and a holding device. This holding device includes an idle pulley 40 on the periphery of which teeth are provided, and which holds the double toothed belt 30 to mesh with the toothed pulley 11 of the upper shaft 10, and holds the double toothed belt 30 to mesh with the toothed pulley 21 of the lower shaft 20, and includes a motor 41 and a toothed pulley 42 mounted on the output shaft of the motor 41.

The upper shaft 10 is rotatably supported in the arm 2 with bearings 3, and provided at its left end portion in FIG.2 with an eccentric portion 12 to reciprocate a needle 13 up and down. At the right end portion of the upper shaft 10 in FIG.2, fixed to the upper shaft 10 is a hand wheel 14 which enables an operator to reciprocate the needle 13 manually, and also in the vicinity of its right end, the toothed pulley 11 is fixed to the upper shaft 10 to be rotatable together therewith.

The lower shaft 20 is rotatably supported under the table 4 with bearings 5, and connected at its left end portion in FIG.2 to a shuttle 6 to rotate the shuttle 6. At the right end portion of the lower shaft 20, the toothed pulley 21 is fixed to the lower shaft 20 to be rotatable together therewith. The double toothed belt 30 is an endless resilient belt made of rubber or the like, with the teeth formed on its both sides along its whole length, and mounted so as to mesh with the toothed pulley 11 and the toothed pulley 21, which are fixed to the upper shaft 10 and the lower shaft 20 to rotate together, respectively. The double toothed belt 30 is arranged to mesh with the idle pulley 40 and the toothed pulley 42 on the output shaft of the motor 41, so that the teeth 31 of the double toothed belt 30 meshes with the toothed pulley 11 of the upper shaft 10, and the teeth 32 of the double toothed belt 30 meshes with the toothed pulley 21 of the lower shaft 20.

The idle pulley 40 and the toothed pulley 42 on the output shaft of the motor 41 are rotatably supported on the brackets 43, 44 which are secured to the table 4 to function as the holding device, respectively. With a slot 43*a* defined on the bracket 43 vertically as shown in FIG. 1 to support a shaft of the idle pulley 40, it is so arranged that the position of the idle pulley 40 mounted on the bracket 43 may be varied vertically, thereby to vary the tension of the double toothed belt 30 as desired.

In operation, the motor 41 is driven to rotate its output shaft with the toothed pulley 42, so that the upper shaft 10 and the idle pulley 40 are rotated clockwise, while the lower shaft 20 is rotated counterclockwise, with the rotational force of the output shaft 42 transmitted to them with the double toothed belt 30. According to the present embodiment, the teeth 31 formed on one side of the double toothed belt 30 are arranged to mesh with the toothed pulley 11 of the upper shaft 10 via the idle pulley 40 and the toothed pulley 42 on the output shaft of the motor 41, while the teeth 32 formed on the other side of the double toothed belt 30 are arranged to mesh with the toothed pulley 21 of the lower shaft 20, so that the upper shaft 10 and the lower shaft 20, which mesh with the teeth formed on the different sides of the double toothed belt 30, can be rotated in the reverse direction to each other. Therefore, any complex mechanism for reversing the rotational direction does not have to be placed between the lower shaft 20 and the shuttle 6, so that the cost is reduced comparing with the prior apparatuses as described before.

Since the toothed pulley 42 mounted on the output shaft of the motor 41 meshes with the double toothed belt 30, maintaining its function as the holding device, the rotational force of the output shaft of the motor 41 can be transmitted to the upper shaft 10 and the lower shaft 20 with the double toothed belt 30, so that no apparatus for driving the motor 41 and the upper shaft 10 synchronously, nor driving the motor 41 and the lower shaft 20 synchronously, is necessitated, which results in decrease in cost.

With the number of teeth on the one side of the double toothed belt 30 varied comparing with the number of teeth on the other side of the double toothed belt 30, the ratio of the rotational speed of the upper shaft 10 and that of the lower shaft 20 can be varied easily. According to the present embodiment, the upper shaft 10 and the lower shaft 20 are connected with the double toothed belt 30, so that the noise level is relatively low comparing with the conventional gear connection mechanism between the upper shaft 10 and the lower shaft 20, while no lubricant is required, and the working accuracy and the assembling accuracy with the arm 2 or the cylindrical member 7 are not required to be so high. Therefore, the apparatus is manufactured at much lower cost than the prior apparatuses.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. A driving apparatus for a sewing machine having a table, an upper rotary shaft provided horizontally above said table for driving a needle, a lower rotary shaft provided horizontally below said table for driving a shuttle, transmission means for transmitting a rotational force to rotate said upper rotary shaft and said lower rotary shaft in synchronous relationship with each other, and power means for providing said rotational force, wherein said transmission means comprises:

a first toothed member provided on said upper rotary shaft for rotating together therewith;

a second toothed member provided on said lower rotary shaft for rotating together therewith;

a double toothed belt provided on both sides thereof with teeth for meshing with said first toothed member and said second toothed member, respectively, and holding means for holding one side of said belt to be meshed with said first toothed member, and holding the other side of said belt to be meshed with said second toothed member, wherein said power means includes an output shaft for driving said double toothed belt, said output shaft holding the one side of said belt to be meshed with said first toothed member, and holding the other side of said belt to be meshed with said second toothed member.

2. The apparatus as defined in claim 1, wherein said holding means includes an idle pulley mounted on said table in parallel spaced relationship with said first and second rotary shafts, said idle pulley having a toothed portion on the periphery thereof meshed with said double toothed belt.

3. The apparatus as defined in claim 1, wherein the number of teeth provided on the one side of said belt is different from the number of teeth provided on the other side of said belt.

4. A driving apparatus for a sewing machine having a table, an upper rotary shaft provided horizontally above said table for driving a needle, and a lower rotary shaft provided horizontally below said table for driving a shuttle, comprising:

a first toothed pulley mounted on said upper rotary shaft and rotated together therewith;

a second toothed pulley mounted on said lower rotary shaft and rotated together therewith;

a motor mounted under said table and having a rotational output shaft provided in parallel spaced relationship with said upper and lower rotary shafts;

a third toothed pulley mounted on the output shaft of said motor and rotated together with the output shaft;

a fourth toothed pulley rotatably mounted under said table, with the central axis of said fourth toothed pulley provided in parallel spaced relationship with said upper and lower rotary shafts; and a double toothed belt provided on both sides thereof with teeth, one side of said belt meshing with said first toothed pulley, said third toothed pulley and said fourth toothed pulley, the other side of said belt meshing with said second toothed pulley.

5. The apparatus as defined in claim 4, wherein said fourth toothed pulley is mounted so as to be movable vertically, and fixed at a position for providing a tension for said belt to mesh with said first, second and third toothed pulleys.

6. The apparatus as defined in claim 5 wherein a bracket is secured to said table, said bracket having a slot defined therein vertically, and wherein said fourth toothed pulley is mounted on said bracket with the axis of said fourth toothed pulley movable along said slot and fixed at the position for providing the tension.

7. The apparatus as defined in claim 4, wherein the number of teeth provided on the one side of said belt is different from the number of teeth provided on the other side of said belt.

* * * * *